US008651904B2

(12) United States Patent
Pellegrinetti et al.

(10) Patent No.: US 8,651,904 B2
(45) Date of Patent: Feb. 18, 2014

(54) PROPELLER DRIVE ARRANGEMENT FOR CONTROLLING AND DRIVING A SHIP

(75) Inventors: Andrea Pellegrinetti, Trento (IT); Michele Zottele, Trento (IT)

(73) Assignee: ZF Friedrichshafen AG, Friedrichshafen (DE)

( * ) Notice: Subject to any disclaimer, the term of this patent is extended or adjusted under 35 U.S.C. 154(b) by 208 days.

(21) Appl. No.: 13/120,990

(22) PCT Filed: Sep. 29, 2009

(86) PCT No.: PCT/EP2009/062611

§ 371 (c)(1), (2), (4) Date: Mar. 25, 2011

(87) PCT Pub. No.: WO2010/037742

PCT Pub. Date: Apr. 8, 2010

(65) Prior Publication Data

US 2011/0177730 A1 Jul. 21, 2011

(30) Foreign Application Priority Data

Oct. 2, 2008 (DE) ..... 10 2008 042 597

(51) Int. Cl.

| | |
|---|---|
| ***B63H 5/20*** | (2006.01) |
| ***B63H 5/125*** | (2006.01) |
| ***B63H 20/08*** | (2006.01) |
| *B63H 20/14* | (2006.01) |
| *B63H 23/00* | (2006.01) |
| *B63H 20/32* | (2006.01) |
| *B63H 21/36* | (2006.01) |
| *B63H 5/07* | (2006.01) |

(52) U.S. Cl.
USPC ..... 440/53; 440/57; 440/75; 440/76; 440/78; 440/79

(58) Field of Classification Search
USPC ..... 440/49, 53, 57, 76, 78, 83, 111, 112, 440/61 S, 75, 79
See application file for complete search history.

(56) References Cited

U.S. PATENT DOCUMENTS 3,486,478 A * 12/1969 Halliday ..... 440/58
3,896,757 A 7/1975 Kucher (Continued)

FOREIGN PATENT DOCUMENTS

DE 858 771 7/1949
DE 12 116 10/1956

(Continued)

*Primary Examiner* — Daniel V Venne
(74) *Attorney, Agent, or Firm* — Davis & Bujold, PLLC; Michael J. Bujold

(57) ABSTRACT

A propeller drive assembly, for steering and driving a ship (1), comprises a drive motor (2) and a transmission housing (4) secured to a ship hull and a control housing (7) secured to an exterior surface of the hull. The control housing (7) comprises a propeller (8) supported on a driven shaft (6) and the control housing (7) is pivotably coupled, via a steering shaft (10), to the transmission housing (4) for steering the ship (1). A transmission output shaft (5) is connected with the driven shaft (6) and a lubricant circuit of the transmission housing (4) is separate from a lubricant circuit of the control housing (7). At least one sealing element is provided, in a region of a shaft passage of the transmission output shaft (5) and in a region of a shaft passage of the steering shaft (10), for mutually sealing the transmission housing lubricant circuit and the control housing lubricant circuit.

14 Claims, 3 Drawing Sheets

(56) References Cited

U.S. PATENT DOCUMENTS

| | | | | |
|---|---|---|---|---|
| 3,901,177 | A | 8/1975 | Scott | |
| 3,931,783 | A | 1/1976 | Croisant | |
| 4,650,430 | A | 3/1987 | Schiek | |
| 5,125,858 | A * | 6/1992 | Salvetti | 440/54 |
| 5,435,762 | A * | 7/1995 | Reuter | 440/54 |
| 6,394,861 | B1 | 5/2002 | Kolb et al. | |
| 7,118,432 | B2 | 10/2006 | Katayama | |
| 2004/0203300 | A1 | 10/2004 | Takahashi | |

FOREIGN PATENT DOCUMENTS

| | | |
|---|---|---|
| DE | 1 027 042 | 3/1958 |
| DE | 1 581 012 | 10/1970 |
| DE | 20 2009 009 031 U1 | 11/2009 |
| GB | 983 462 | 2/1965 |

* cited by examiner

CONTROL HOUSING LUBRICATION CIRCUIT

PROPELLER DRIVE ARRANGEMENT FOR CONTROLLING AND DRIVING A SHIP

This application is a National Stage completion of PCT/EP2009/062611 filed Sep. 29, 2009, which claims priority from German patent application serial no. 10 2008 042 597.4 filed Oct. 2, 2008.

FIELD OF THE INVENTION

The present invention relates to a propeller drive assembly for steering and driving a ship.

BACKGROUND OF THE INVENTION

So-called pod drives for ships are known. Such drives are propeller drive assemblies for steering and driving a ship, which comprise a streamlined pod, for instance, as the control housing, which can be rotated or swivelled about a vertical axis to steer the ship. The propeller drive assembly comprises a transmission which is coupled to an engine via a drive shaft. Both the transmission and the engine are disposed in the hull. The control housing comprising a propeller is located in the water, however, i.e., outside of the hull. In order to cool the common lubricant circuit in the transmission housing and in the control housing, an external heat exchanger disposed in the saltwater circuit of the engine, which also cools the engine coolant, is used in known propeller drive assemblies.

Furthermore, an outboard drive unit for a ship is known from published patent U.S. Pat. No. 7,118,434 B2. The outboard drive unit comprises an underwater housing in which two propeller shafts for driving two propellers are mounted. Each propeller shaft is driven in the underwater housing by a bevel gearing. The underwater housing is rigidly held, at an opening in the hull, for connection to a transmission housing. The transmission housing is disposed in the hull and is driven by a drive motor which is likewise disposed in the hull. A common oil reservoir is provided, outside of the two housings, for cooling the common oil circuit of the transmission housing and the underwater housing.

If the control housing of the known propeller drive assembly or the underwater housing of the known outboard drive unit are damaged in a collision, for example, such that leakage occurs, all of the oil may leak out of the common lubricant circuit into the water. This is particularly disadvantageous and absolutely must be avoided.

SUMMARY OF THE INVENTION

The problem addressed by the present invention is, therefore, that of providing a propeller drive assembly of the initially described type, which is designed to ensure that not all of the lubricant will be lost if a leak occurs.

The problem addressed by the invention can be solved by a propeller drive assembly, for steering and driving a ship, having at least one drive motor and at least one transmission housing in a hull, and at least one control housing outside of the hull comprising at least one propeller on a driven shaft, wherein the control housing is pivotably disposed via a steering shaft on the transmission housing for steering the ship, and wherein a transmission output shaft is coupled to the driven shaft. According to the invention, separate lubricant circuits are provided for the transmission housing and the control housing.

The mutually sealed, independent lubricant circuits ensure that increased safety requirements are met with the propeller drive assembly, according to the invention, since only a small quantity of lubricant can escape if a collision occurs.

To achieve the mutual sealing of the two lubricant circuits of the housing, according to a possible variant embodiment, it is possible to seal the sealing points between the transmission housing and the control housing accordingly. Potential sealing points are the regions of the shaft passages of the transmission output shaft and the steering shaft. It is therefore possible to use at least one sealing element in each of these regions. Any suitable element, that reliably prevents lubricant or oil from escaping from one lubricant circuit and entering the other lubricant circuit, can be used as the sealing element.

Preferably the shaft passage can be sealed at the transmission output shaft using at least one radial shaft seal or the like. In that particular case, a type of radial shaft seal that is adapted to the installation situation can be selected from among the various available designs thereof, depending on the embodiment of the transmission output shaft and the surrounding components.

It is feasible, for example, to use a radial shaft seal having a sealing ring composed of metal or the like, for instance, on which at least one sealing lip or the like is disposed. In this type of radial shaft seal, the sealing ring can be connected to the steering shaft in the region of the shaft passage of the transmission output shaft, and the at least one sealing lip of the radial shaft seal can rest on a receiving element or the like enclosing at least a portion of the transmission output shaft. The shaft passages designed as radial gap between the steering shaft and the transmission output shaft or the vertical shaft of the transmission are therefore sealed, and so lubricant is prevented from escaping from the transmission housing along the transmission output shaft, into the control gearcase, and from there into the environment.

Depending on the embodiment of the transmission housing and the transmission output shaft mounted therein, it is also possible for at least one sealing lip of the radial shaft seal to rest directly on the transmission output shaft, for example. This is the case, in particular, when there is no receiving element for the transmission output shaft disposed in the region of the shaft passage. A plurality of sealing lips may also be used, in which case one rests on the receiving element and one rests on the transmission output shaft. Other structural embodiments are also feasible.

A further sealing point exists in the region of the shaft passage of the steering shaft between the transmission housing and the control housing, for example. This region must also be sealed accordingly. If the steering shaft is designed as a hollow shaft, for example, the steering shaft can be fixedly connected to an adapter plate or the like, for example. The adapter plate is fixedly connected to the control housing, and is rotatably mounted on the transmission housing. In this manner, the control housing can be accordingly rotated or swivelled, via the steering shaft, in order to steer the ship. In this embodiment, the sealing points must be sealed in the region of the shaft passages of the steering shaft. In that particular case, a sealing point exists between the adapter plate and the steering shaft, and another sealing point exists between the adapter plate and the transmission housing.

Since the connection between the steering shaft and the adapter plate is a fixed connection, preferably at least one O-ring seal, or the like, can be used according to a possible development of the invention. The connection between the adapter plate and the transmission housing is a rotatable connection, and so preferably a rectangular-section ring or the like, for example, is used here. Other seals that perform the relevant sealing function may also be used.

Further sealing points may need to be sealed, under certain circumstances, depending on the embodiment of the sealing region between the transmission housing and the control housing.

Within the scope of the present invention, a plurality of propeller drive assemblies, according to the invention, may also be disposed together in one ship for the driving and steering thereof.

BRIEF DESCRIPTION OF THE DRAWINGS

The present invention will be explained in greater detail below with reference to the drawings. In the drawings.

DETAILED DESCRIPTION OF THE PREFERRED EMBODIMENTS

Figure 1:
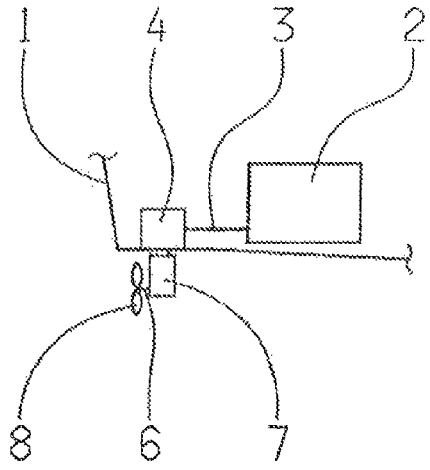
FIG. 1 shows a schematic view of a propeller drive assembly for steering and driving a ship.

FIG. 1 is a schematic depiction of a propeller drive assembly for driving and steering a ship 1, wherein the ship 1 is indicated merely in the form of a hull wall. The propeller drive assembly comprises a drive motor 2 which is coupled, via a drive shaft 3, to a transmission input shaft, which is not depicted further, in a transmission of a transmission housing 4 to transfer engine torque, via the transmission output shaft 5, to a driven shaft 6 in a control housing 7 to drive at least one propeller 8.

The drive motor 2 and the transmission housing 4 are disposed in the hull, i.e., outside of the water. The control housing 7 comprising the propeller 8 is disposed below the hull, i.e., in the water.

Figure 2:
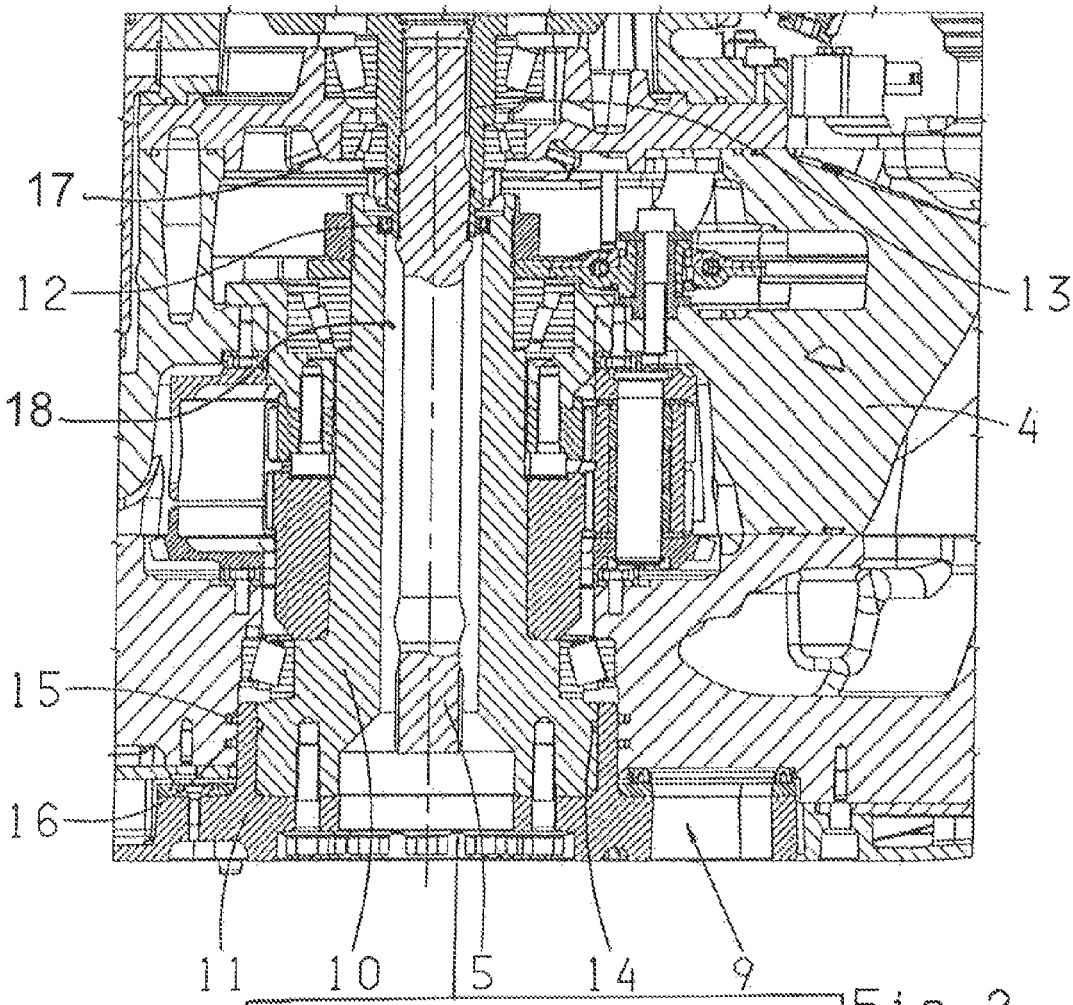
FIG. 2 shows an exposed partial view of a transmission housing of the propeller drive assembly, according to the invention, comprising a connection region to a control housing adjacent thereto.
Figure 3:
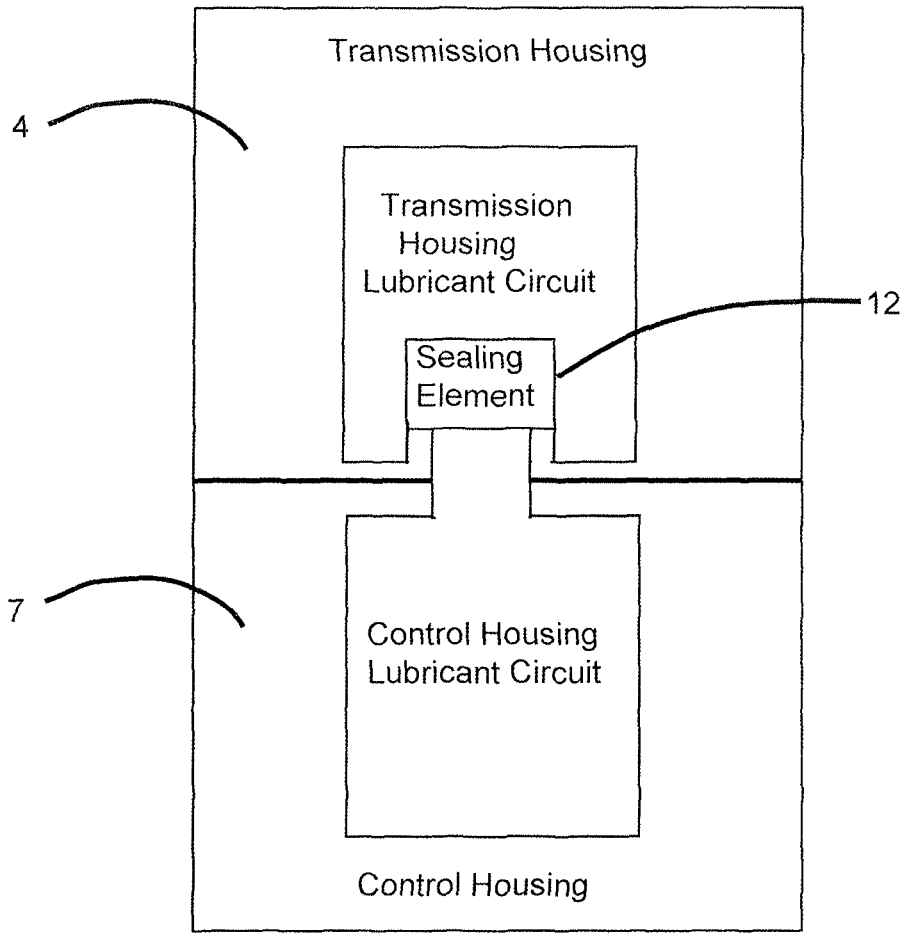
FIG. 3 shows a schematic partial representation of the separate lubricant circuits of the transmission housing and the control housing.
Figure 4:
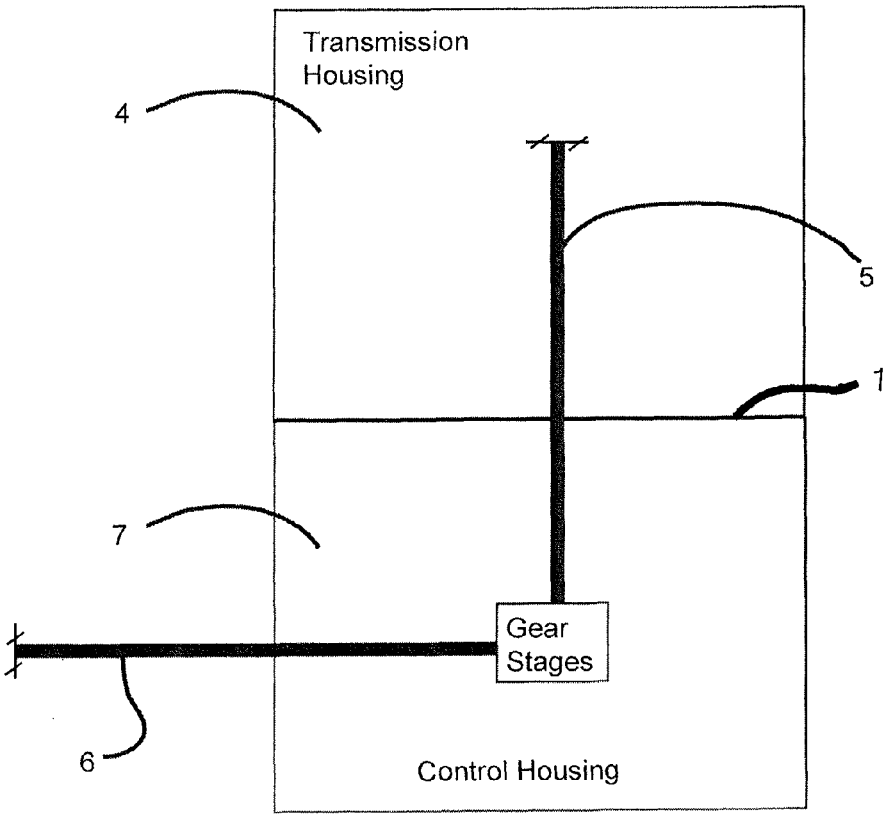
FIG. 4 shows a schematic partial representation of the transmission output shaft connection with the driven shaft.

FIG. 2 shows an exposed partial view of the transmission housing 4 of the propeller drive assembly, according to the invention, comprising a connection region 9, adjacent to which the control housing 7—which is not depicted further in FIG. 2—is rotatably or pivotably disposed for steering the ship. The transmission housing 4 comprises a bevel gearing, only part of which is depicted, for transferring torque from the transmission input shaft to the transmission output shaft 5, which is in the form of a vertical shaft, and a control transmission for transferring the steering motion to a steering shaft 10. The steering shaft 10 is in the form of a hollow shaft and encloses at least a portion of the transmission output shaft 5.

The transmission input shaft is connected to the drive shaft 3 of the drive motor 2, which is not depicted further in FIG. 2. The torque transferred by the drive shaft 3 is transferred, by gear stages of the bevel gearing, to the transmission output shaft 5. The transmission output shaft 5 is coupled, via further gear stages in the control housing 7, to the driven shaft 6 for driving the propeller 8.

The control housing 7 is connected, via an adapter plate 11, to the steering shaft 10 designed as a hollow shaft, and therefore the control housing 7 is rotated or swivelled about the vertical axis with the steering shaft 10 when a steering motion is carried out, via the control transmission, to implement a desired steering motion of the ship 1.

According to the invention, the lubricant channel in the transmission housing 4 and the lubricant channel in the control housing 7 are separated from each other in the proposed propeller drive assembly. Oil is preferably used as lubricant. It is thereby ensured that all of the lubricant or oil will not escape from the housing if a leak occurs in one of the housings in the event of a collision.

To seal the two lubricant circuits with respect to one another (i.e., form a lubricant tight seal), at least one first sealing element 12 must be provided in the region of the shaft passage of the transmission output shaft 5 and at least one second sealing element 14 must be provided in the region of the shaft passages of the steering shaft 10.

As shown in FIG. 2, the shaft passage at the transmission output shaft 5 is provided with a radial shaft seal 12, e.g., the first sealing element. The radial shaft seal 12 is indicated merely symbolically in FIG. 2. This means that any type of radial shaft seal can be used there or at another point.

Preferably a metal sealing ring can be used as radial shaft seal 12, on which at least one sealing lip made of plastic, for example, is provided. The sealing ring is preferably fastened to the inner diameter of the steering shaft 10, and therefore the sealing lip preferably rests on a receiving element 13 which encloses at least a portion of the transmission output shaft 5. The sealing lip can also rest directly on the transmission output shaft 5. As shown in FIG. 2, the radial seal 12 forms a seal between a transmission housing lubricant circuit channel (diagrammatically indicated by element 17) and a control housing lubricant circuit channel (diagrammatically indicated by element 18).

At least one O-ring seal 14 is used as the second sealing element, between the outer circumference of the steering shaft 10 and the adapter plate 11, to seal the region of the shaft passages of the steering shaft 10. Lubricant is thereby prevented from entering the sealing gap between the fixed connection of the steering shaft 10 and the adapter plate 11.

Moreover, two rectangular-section ring seals 15,16 are provided, between the adapter plate 11 and the transmission housing 4, to seal the region of the shaft passages of the steering shaft 10. Other geometric shapes of the seals are also possible. The rotatable connection, between the adapter housing 11 and the control housing 7 and between the adapter housing 11 and the transmission housing 4, is established in this manner.

REFERENCE CHARACTERS

1 ship
2 drive motor
3 drive shaft
4 transmission housing
5 transmission output shaft
6 driven shaft
7 control housing
8 propeller
9 connection region
10 steering shaft
11 adapter plate
12 radial shaft seal
13 receiving element
14 O-ring seal
15 rectangular-section ring seal
16 rectangular-section ring seal

The invention claimed is:

1. A propeller drive assembly for steering and driving a ship (1), the propeller drive assembly comprising:

at least one drive motor (2) and at least one transmission housing (4) supported by a hull of the ship;

a control housing (7) secured to an outside of the hull, the control housing (7) comprising at least one propeller (8) supported on a driven shaft (6), and the control housing (7) being pivotably disposed, via a steering shaft (10), on the transmission housing (4) for steering the ship (1);

a transmission output shaft (5) being coupled to the driven shaft (6); and a transmission housing lubricant circuit for the transmission housing (4) and a separate control housing lubricant circuit for the control housing (7);

wherein a first sealing element (12), engages a shaft passage of the transmission output shaft (5) and a second sealing element (14) engages a shaft passage of the steering shaft (10) and the first sealing element (12) directly communicates with both the transmission housing lubricant circuit and the control housing lubricant circuit and separates the transmission housing lubricant circuit from the control housing lubricant circuit so as to form a lubricant tight seal and prevent fluid communication between the transmission housing lubricant circuit and the control housing lubricant circuit.

2. The propeller drive assembly according to claim 1, wherein the first sealing element (12) comprises a radial shaft seal (12) and a shaft passage of the transmission output shaft (5) is sealed, via the radial shaft seal (12), so as to prevent fluid communication between the transmission housing lubricant circuit and the control housing lubricant circuit, the radial shaft seal being radially located between the transmission output shaft and an interior of the steering shaft.

3. The propeller drive assembly according to claim 1, wherein the first sealing element (12) comprises a radial shaft seal (12) and a sealing ring of the radial shaft seal (12) is connected to the steering shaft (10), and at least a portion of the radial shaft seal (12) rests directly against a receiving element (13) which radially encloses at least a portion of the transmission output shaft (5).

4. The propeller drive assembly according to claim 1, wherein the first sealing element (12) comprises a radial shaft seal (12) and at least a portion of the radial shaft seal (12) rests directly against the transmission output shaft (5).

5. The propeller drive assembly according to claim 1, wherein the steering shaft (10) is a hollow shaft, an adapter plate (11) is connected to the steering shaft (10) in a rotationally fixed manner, adjacent to the shaft passage of the steering shaft (10), and the adapter plate (11) is rotatably mounted on the transmission housing (4).

6. The propeller drive assembly according to claim 5, wherein the second sealing element (14) comprises at least one O-ring seal (14) provided radially between the steering shaft (10) and the adapter plate (11) for sealing the shaft passage of the steering shaft (10).

7. The propeller drive assembly according to claim 5, wherein at least one rectangular-section ring (15,16) is provided radially between the adapter plate (11) and the transmission housing (4) for sealing the shaft passage of the steering shaft (10).

8. A propeller drive assembly for facilitating both steering and driving a ship (1), the propeller drive assembly comprising:

at least one drive motor (2) and at least one transmission housing (4) being secured to an upper surface of a hull of the ship, the transmission housing having a shaft passage;

a control housing (7) being secured to an exterior surface of the hull, the control housing (7) comprising at least one propeller (8) being supported on a driven shaft (6), and the control housing (7) being pivotably coupled, via a steering shaft (10), to the transmission housing (4) for steering the ship (1), the steering shaft passing through the shaft passage in the transmission housing and the steering shaft having a shaft passage;

a transmission output shaft (5) being connected with the driven shaft (6), the transmission output shaft passing through the shaft passage in the steering shaft, and the transmission housing (4) having a transmission housing lubricant circuit and the control housing (7) having a separate control housing lubricant circuit;

wherein at least one first sealing element is arranged within the shaft passage in the steering shaft radially between the transmission output shaft (5) and the steering shaft and at least a second sealing element is arranged within the shaft passage in the transmission housing radially between the steering shaft (10) and the transmission housing, the at least one first sealing element mutually sealing the transmission housing lubricant circuit from the control housing lubricant circuit and thereby form lubricant tight seals which preventing fluid communication between the transmission housing lubricant circuit and the control housing lubricant circuit.

9. The propeller drive assembly according to claim 1, wherein the at least one first sealing element is provided adjacent to a shaft passage of the transmission output shaft (5) and the at least one second sealing element is provided adjacent to a shaft passage of the steering shaft (10).

10. The propeller drive assembly according to claim 1, wherein the at least one first sealing element is provided adjacent to both a shaft passage of the transmission output shaft (5) and a shaft passage of the steering shaft (10).

11. A propeller drive assembly for steering and driving a ship (1), the propeller drive assembly comprising:

a drive motor (2) and a transmission housing (4) supported by a hull of the ship, and the transmission housing (4) including a transmission housing lubricant circuit;

a control housing (7) secured to an outside of the hull, the control housing (7) comprising at least one propeller (8) supported on a driven shaft (6), the control housing (7) being pivotably disposed, via a steering shaft (10), on the transmission housing (4) for steering the ship (1), and the control housing (7) including a control housing lubricant circuit;

a transmission output shaft (5) being coupled to the driven shaft (6); and a first sealing element engaging with a shaft passage of the steering shaft (10) and the first sealing element communicates with both the transmission housing lubricant circuit and the control housing lubricant circuit and separating the transmission housing lubricant circuit from the control housing lubricant circuit so as to form a lubricant tight seal therebetween and prevent fluid communication between the transmission housing lubricant circuit and the control housing lubricant circuit.

12. The propeller drive assembly according to claim 11, wherein at a second sealing element is arranged within the shaft passage in the transmission housing radially between the steering shaft (10) and the transmission housing.

13. The propeller drive assembly according to claim 12, wherein a first surface of the first sealing element directly communicates with the transmission housing lubricant circuit and an opposed second surface of the circuit seal is directly communicates with the control housing lubricant circuit.

14. The propeller drive assembly according to claim 11, wherein a first surface of the first sealing element directly communicates with the transmission housing lubricant circuit and an opposed second surface of the circuit seal is directly communicates with the control housing lubricant circuit.

* * * * *